US010649403B2

(12) United States Patent
Ding et al.

(10) Patent No.: US 10,649,403 B2
(45) **Date of Patent: *May 12, 2020**

(54) PROCESS CARTRIDGE AND POWER SUPPLY METHOD THEREFOR

(71) Applicant: ZHONGSHAN KINGWAY IMAGE TECH CO., LTD, Zhongshan, Guangdong (CN)

(72) Inventors: Xueping Ding, Guangdong (CN); Junqing Liu, Guangdong (CN); Zhengjun Zhou, Guangdong (CN); Jizhong Wang, Guangdong (CN)

(73) Assignee: ZHONGSHAN KINGWAY IMAGE TECH CO., LTD., Zhongshan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/104,952

(22) Filed: Aug. 20, 2018

(65) Prior Publication Data

US 2018/0356766 A1 Dec. 13, 2018

Related U.S. Application Data

(63) Continuation of application No. 15/595,905, filed on May 15, 2017, now Pat. No. 10,101,705, and a (Continued)

(30) Foreign Application Priority Data

Dec. 6, 2014 (CN) ..... 2014 1 0740806
Jan. 16, 2015 (CN) ..... 2015 1 0024384
Mar. 26, 2015 (CN) ..... 2015 1 0138067

(51) Int. Cl.
*G03G 21/18* (2006.01)
*G03G 15/00* (2006.01)

(52) U.S. Cl.
CPC ..... *G03G 21/1867* (2013.01); *G03G 15/80* (2013.01)

(58) Field of Classification Search
CPC ..... G03G 21/1864; G03G 15/80
See application file for complete search history.

(56) References Cited

U.S. PATENT DOCUMENTS

2010/0129102 A1* 5/2010 Fujihara ..... G03G 15/065 399/55
2011/0305482 A1* 12/2011 So ..... G03G 21/1867 399/120
2016/0033921 A1* 2/2016 Kim ..... G03G 15/80 399/24

* cited by examiner

*Primary Examiner* — Gregory H Curran
(74) *Attorney, Agent, or Firm* — Anova Law Group, PLLC

(57) ABSTRACT

The present invention discloses a process cartridge and a power supply method therefor. The process cartridge is detachably mounted in an electrophotographic image forming apparatus, comprising a developing member rotatably mounted in the process cartridge and a voltage generating unit, the voltage generating unit is electrically connected to the conductive contact and the developing member. The process cartridge supplies power by using a data line, and the power supply method comprises: providing a conductor, and transmitting electric energy on the data line to the voltage generating unit by using the conductor. When the process cartridge is mounted in an electrophotographic image forming apparatus that outputs a DC bias voltage, because the voltage generating unit can generate an AC bias voltage, the process cartridge can work in an electrophotographic image forming apparatus that outputs a DC bias voltage and also in an apparatus that outputs an AC bias voltage.

20 Claims, 20 Drawing Sheets

Related U.S. Application Data continuation of application No. PCT/CN2015/083241, filed on Jul. 3, 2015.

C03

PROCESS CARTRIDGE AND POWER SUPPLY METHOD THEREFOR

CROSS REFERENCE TO RELATED APPLICATIONS

This application is a continuation application of U.S. Ser. No. 15/595,905 filed on May 15, 2017, which is a national phase application of PCT/CN2015/083241 filed on Jul. 3, 2015, which claims priority to Chinese applications CN201410740806.4 filed on Dec. 6, 2014, CN201510024384.5 filed on Jan. 16, 2015, and CN201510138067.6 filed on Mar. 26, 2015, the entire contents of which are incorporated herein by reference.

TECHNICAL FIELD

The present invention relates to the field of electrophotographic image forming, and in particular, to a process cartridge detachably mounted in an electrophotographic image forming apparatus and a power supply method for the process cartridge.

BACKGROUND OF THE INVENTION

Generally, a process cartridge detachably mounted in an electrophotographic image forming apparatus includes at least a toner frame. The toner frame contains a developer and a developing member that carries the developer. The electrophotographic image forming apparatus includes a printer, a duplicating machine, and the like. Hereinafter, a printer is used for description. In a working process of the printer, a photosensitive member for forming an electrostatic latent image is generally disposed separately in the printer, or disposed together with the developing member in the toner frame, or disposed separately in a waste toner frame used for containing a waste developer, where the waste toner frame is combined with the toner frame to constitute the process cartridge.

An image forming process of the printer generally includes steps of charging, exposure, developing, transfer, fixing, and cleaning. First, a charging member disposed in the printer or process cartridge charges the surface of the photosensitive member. After being charged, the photosensitive member is exposed by the laser beams which include digital image signals in the printer, and thereby an electrostatic latent image is formed on the surface of the photosensitive member. The electrostatic latent image is developed by the developing member that carries the developer. Then a transfer apparatus transfers the image to a recording medium, and a fixing apparatus heats the image and presses the image to the recording medium. The printer outputs the recording medium. Finally, a cleaning apparatus cleans the photosensitive member, and thereby the image forming process is completed.

According to whether the developing member contacts the photosensitive member when the printer works, developing methods may be classified into a contact-type developing method and a jump-type developing method. In the contact-type developing method, the developing member and the photosensitive member contact with each other, the printer applies a DC bias voltage to the developing member to form an electric field between the developing member and the photosensitive member, the developer located on the developing member is moved from the surface of the developing member to the surface of the photosensitive member under the action of the electric field, and thereby an said electrostatic latent image is developed. In the jump-type developing method, the developing member and the photosensitive member do not contact with each other but have a predetermined gap, and the printer applies a voltage after superimposition of a DC bias voltage and an AC bias voltage to the developing member; however, in the developing process, the AC bias voltage plays a major role, the developer located on the developing member jumps over the gap from the surface of the developing member to the surface of the photosensitive member under the action of an AC electric field, and thereby an electrostatic latent image is also developed.

FIG. 1 is a schematic diagram of an overall structure of a process cartridge C01 (hereinafter "process cartridge C01" for short) using the contact-type developing method in the prior art. FIG. 2 is a cross-section diagram of an A-A section in FIG. 1. As shown in FIG. 1, the process cartridge C01 includes a toner frame 10 and a waste toner frame 20 that are combined with each other, and a conductive end cover E and a drive end cover F that are respectively located at a conductive end and a drive end in the toner frame. As shown in FIG. 2, the toner frame 10 includes a developer container 11, a stirring member 12, a developer transmission member 13, a developing member 14, a photosensitive member 15, a developer layer adjusting member 16, and a sealing member 17. The stirring member 12 is rotatably disposed in the developer container 11, and configured to stir the developer and provide the developer to the developer transmission member 13. The developer transmission member 13, developing member 14, and photosensitive member 15 are supported by the conductive end cover E and drive end cover F, and sequentially mounted in contact in the toner frame 10. The developer transmission member 13 is configured to transmit the developer to the developing member 14, and a redundant developer on the developing member 14 is adjusted by the developer layer adjusting member 16; meanwhile, the developer is frictionized, so that the developer is charged. The sealing member 17 is used for sealing in a longitudinal direction of the developing member 14. The waste toner frame 20 includes a waste developer container 21, a charging member 22, and a cleaning member 23. The charging member 22 is configured to charge the surface of the photosensitive member 15 before development. The cleaning member 23 is configured to clean a residual developer on the photosensitive member 15 after development. For ease of holding the process cartridge C01, the process cartridge C01 further includes a handle 24 disposed on the waste toner frame 20.

FIG. 3 is a cross-section diagram of a process cartridge C02 (hereinafter "process cartridge C02" for short) using the jump-type developing method in the prior art. A structure of the process cartridge C02 is approximately the same as that of the foregoing process cartridge C01, and same numbers are used for same components in the two process cartridges. The process cartridge C02 differs from the process cartridge C01 in that a gap g is reserved between the developing member 14 and the photosensitive member 15. Therefore, to ensure that the developer can jump over the gap from the surface of the developing member 14 to the surface of the photosensitive member 15, a developing voltage applied to the process cartridge C02 by a printer to which the process cartridge C02 is applicable is a voltage after superimposition of a DC bias voltage and an AC bias voltage.

SUMMARY OF THE INVENTION

When a process cartridge C01 used by a terminal user needs to be replaced due to exhaustion of the developer, as described above, because a printer to which the process cartridge C01 is applicable and a printer to which the process cartridge C02 is applicable supply completely different developing voltages, the terminal user must find a process cartridge of the same type as the process cartridge C01 before use.

In view of this, the present invention provides a process cartridge. The process cartridge may be used in a printer to which the process cartridge C01 is applicable. In addition, the present invention further provides a power supply method for the process cartridge.

The process cartridge provided by the present invention uses the following technical solutions:

A process cartridge detachably mounted in an electrophotographic image forming apparatus, where a conductive contact is disposed on an inner wall of the electrophotographic image forming apparatus, and the process cartridge includes a developing member rotatably mounted in the process cartridge; and the process cartridge further includes a voltage generating unit, where the voltage generating unit is electrically connected to the conductive contact and the developing member, and the voltage generating unit outputs an AC bias voltage to the developing member, the voltage generating unit receives a start-up signal from the conductive contact.

The start-up signal is from a developing voltage contact of the developing member, or a charging voltage contact of the charging member, or a transmission voltage contact of the developer transmission member.

The process cartridge further includes a power supply part, where the power supply part is connected to the voltage generating unit, the electrophotographic image forming apparatus acquires data information by using a data line, and the power supply part is a battery or a generator or is at least a conductor connected to the voltage generating unit and the data line; the voltage generating unit includes a DC-DC boost circuit, a power supply electronic switch circuit, an oscillation circuit, a comparator amplifier circuit, a power drive circuit, and a transformer boost circuit.

When the power supply part is a generator, the process cartridge further includes a driving force transmission part, where the driving force transmission part cooperates with the conductive end of the developing member and a rotation axis of the generator respectively.

A power supply method for a process cartridge, where the process cartridge is detachably mounted in an electrophotographic image forming apparatus, where a conductive contact is disposed on an inner wall of the electrophotographic image forming apparatus, and data information is acquired from a data source by using a data line; the process cartridge includes a voltage generating unit and a developing member rotatably mounted in the process cartridge, where the voltage generating unit is electrically connected to the conductive contact and the developing member; and the method includes: providing a conductor, and transmitting electric energy on the data line to the voltage generating unit by using the conductor, the voltage generating unit receives a start-up signal from the conductive contact.

Preferably, the power supply method further includes a step of providing a transfer unit, and connecting the transfer unit to the data line and the conductor respectively.

The transfer unit includes a first transfer module, a second transfer module, and a third transfer module, where the second transfer module is electrically connected to the first transfer module and the third transfer module respectively.

The first transfer module has a power output port, the second transfer module has a second transfer module socket, and the third transfer module has a third transfer module socket; one end of the conductor is connected to the voltage generating unit, and a power interface is disposed at the other end; and the power output port is connected to the power interface, the second transfer module socket is connected to one end of the data line, and the third transfer module socket is connected to the electrophotographic image forming apparatus.

When the process cartridge of the present invention is mounted in an electrophotographic image forming apparatus that outputs a DC bias voltage, because the voltage generating unit can generate an AC bias voltage, the process cartridge of the present invention can not only work in an electrophotographic image forming apparatus that outputs a DC bias voltage, but also work in an electrophotographic image forming apparatus that outputs an AC bias voltage.

DETAILED DESCRIPTION OF THE INVENTION

The embodiments of the present invention are hereinafter described in detail with reference to FIG. 4 to FIG. 19, where same numbers are used for same components in the embodiments and background.

[Overall Structure of Process Cartridge C03]

Figure 1:
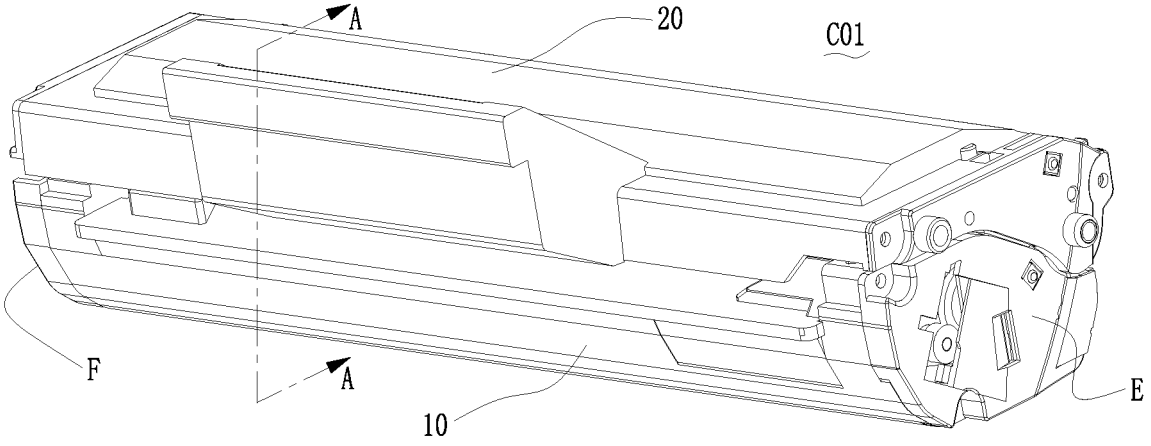
FIG. 1 (Prior Art)
FIG. 1 is a schematic diagram of an overall structure of a process cartridge C01 using contact-type developing in the prior art.
Figure 2:
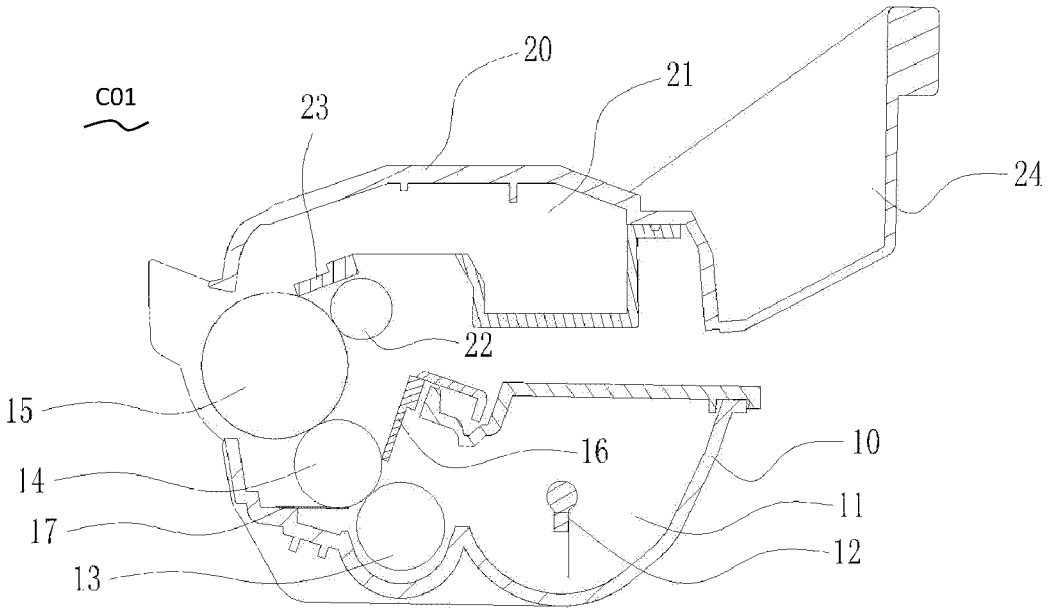
FIG. 2 (Prior Art)
FIG. 2 is a cross-section diagram of an A-A section in FIG. 1.
Figure 3:
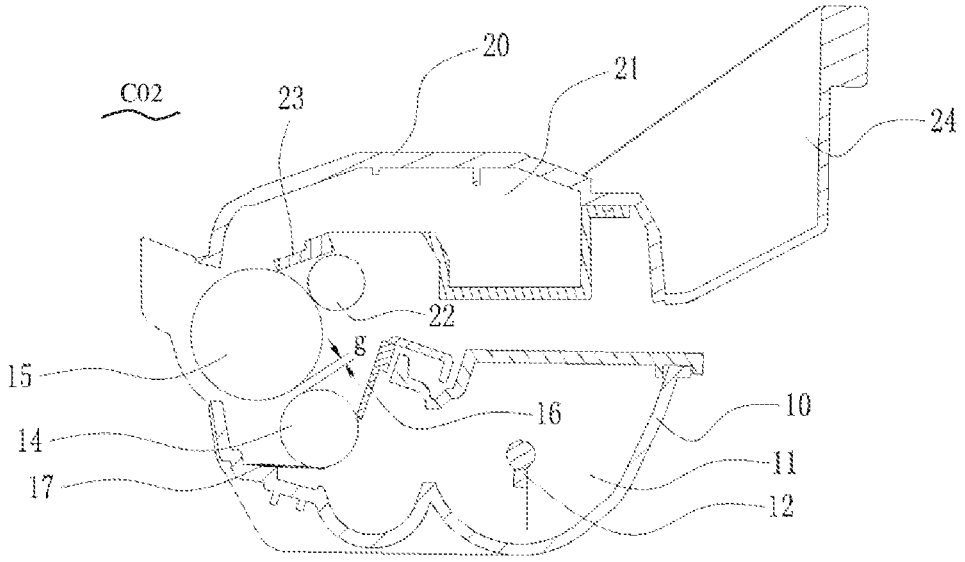
FIG. 3 (Prior Art)
FIG. 3 is a cross-section diagram of a process cartridge C02 that uses jump developing in the prior art.
Figure 4:
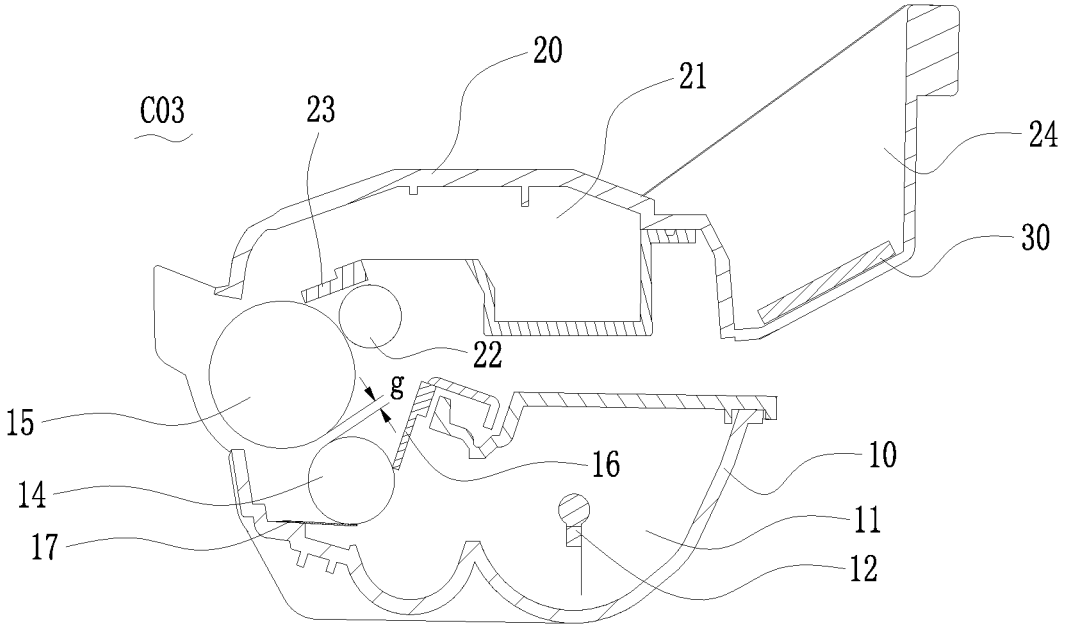
FIG. 4 is a cross-section diagram of a process cartridge C03 involved in the present invention.
Figure 5:
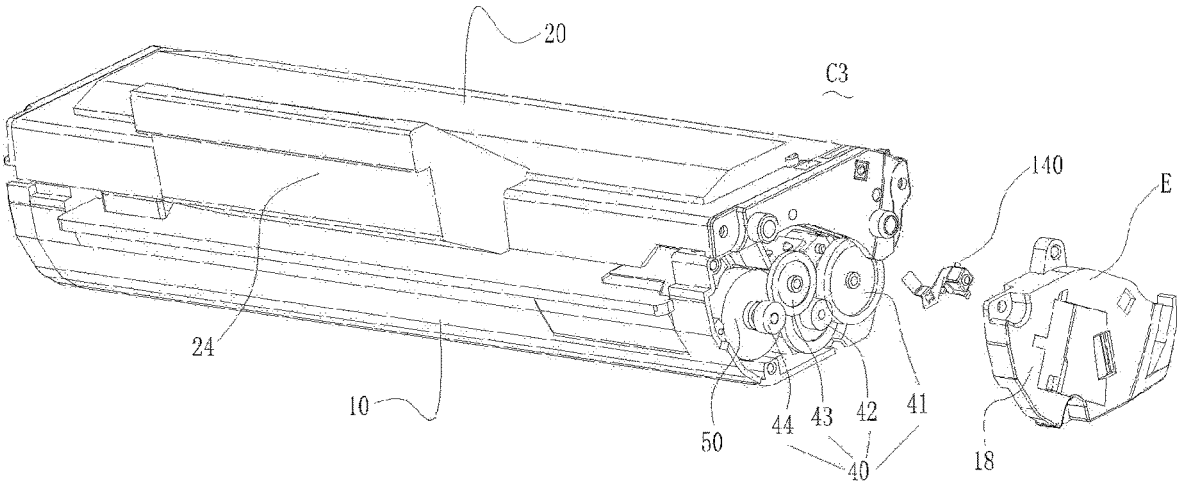
FIG. 5 is a schematic diagram of decomposition of some components of the process cartridge C03 involved in the present invention.

FIG. 4 is a cross-section diagram of a process cartridge C03 involved in the present invention. FIG. 5 is a schematic diagram of decomposition of some components of the process cartridge C03 involved in the present invention. The process cartridge C03 is detachably mounted in an electrophotographic image forming apparatus P (a printer), where a conductive contact 71 is disposed on an inner wall of the printer P. As shown in the figures, the process cartridge C03 includes at least a toner frame 10, where the toner frame 10 includes a developer container 11, a developing member 14, and a voltage generating unit 30. A part of the toner frame 10 forms the developer container 11 for containing the developer. The developing member 14 is rotatably mounted in the toner frame 10, and configured to carry the developer for development. The voltage generating unit 30 is electrically connected to the conductive contact 71 of the printer P and the developing member 14.

As described above, a photosensitive member for forming an electrostatic latent image may be disposed separately in the printer P, or rotatably disposed together with the developing member 14 in the toner frame 10, or rotatably disposed separately in a waste toner frame 20 used for containing a waste developer, where the waste toner frame 20 is combined with the toner frame 10 to constitute the process cartridge. In the embodiment of the present invention, a process cartridge formed by disposing a photosensitive member 15 together with the developing member 14 in the toner frame 10 is used as an example for description. Likewise, the process cartridge C03 further includes a stirring member 12 that is rotatably disposed in the toner frame 10, a developer layer adjusting member 16, and a sealing member 17. Both the developer layer adjusting member 16 and the sealing member 17 are disposed in contact with the surface of the developing member 14. The developer layer adjusting member 16 adjusts the thickness of a developer layer by scraping a redundant developer on the surface of the developing member 14. The sealing member 17 is used for sealing in a longitudinal direction of the developing member 14 to prevent leakage of the developer.

Figure 7:
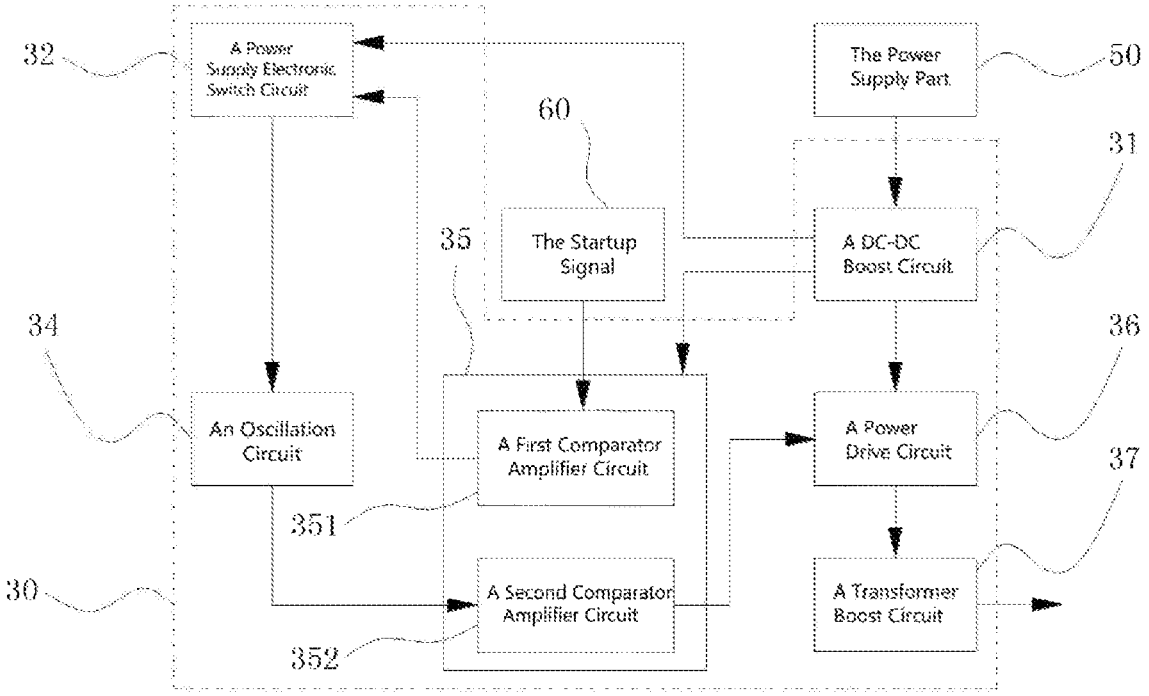
FIG. 7 is a schematic block diagram of a voltage generating unit according to an embodiment of the present invention.

As shown in FIG. 4, the process cartridge C03 further includes the photosensitive member 15 that is rotatably mounted in the toner frame 10. A gap g exists between the photosensitive member 15 and the developing member 14. When a terminal user mounts the process cartridge C03 in the printer P to which the process cartridge C01 is applicable for use, the voltage generating unit 30 receives a DC bias voltage from the printer P and uses it as a start-up signal 60 (as shown in FIG. 7), and generates an AC bias voltage required by the process cartridge C03, and finally outputs the voltage to the developing member 14.

The process cartridge C03 of the present invention further includes the waste toner frame 20. The waste toner frame 20 includes a waste developer container 21, a charging member 22, and a cleaning member 23. A part of the waste toner frame 20 forms the waste developer container 21 for containing waste developer. The charging member 22 is rotatably mounted in the waste toner frame 20, and configured to charge the surface of the photosensitive member 15 before development. The cleaning member 23 is fixedly mounted in the waste toner frame 20, it contacts the surface of the photosensitive member 15, and is configured to clean a residual developer on the photosensitive member 15 after development.

For ease of holding the process cartridge C03 by the terminal user, as described above, the process cartridge C03 further includes a handle 24 disposed on the waste toner frame 20. In the embodiment of the present invention, the voltage generating unit 30 is disposed in the handle 24, and connected to the conductive contact 71 of the printer P and the developing member 14 respectively by using a conductor 74. Alternatively, the voltage generating unit 30 may be disposed in any other position of the process cartridge C03, as long as the voltage generating unit 30 can be electrically connected to the conductive contact 71 of the printer P and the developing member 14 respectively by using a conductor 74. The other position may be, for example, one of inner and outer surfaces of the toner frame 10, inner and outer surfaces of the waste toner frame 20, and a conductive end cover or a drive end cover of the toner frame 10.

Figure 16:
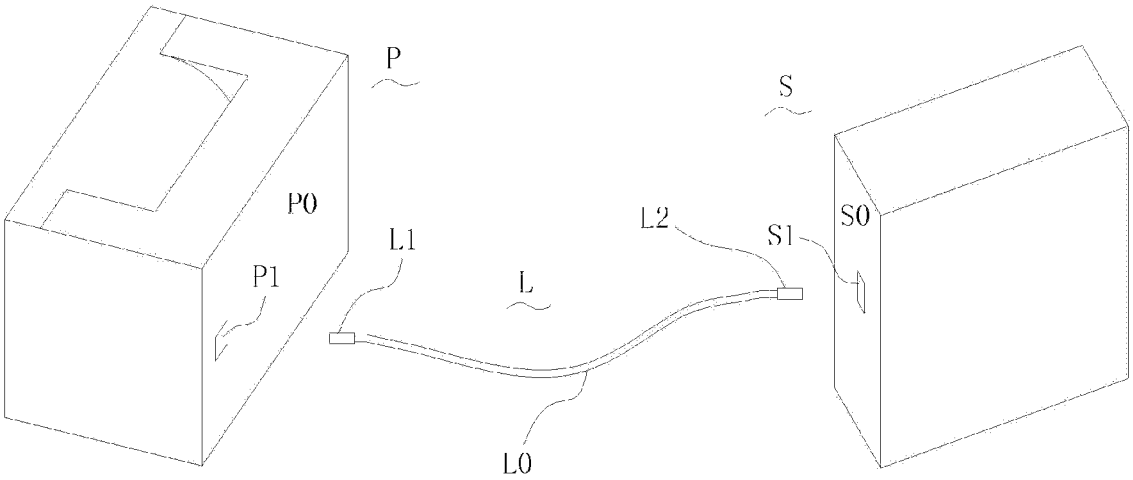
FIG. 16 is a schematic diagram of data reception by a printer P in the prior art.

As shown in FIG. 5, the process cartridge C03 further includes a power supply part 50 for supplying power to the voltage generating unit 30. The power supply part 50 may be a generator, and the generator is disposed at the conductive end of the toner frame 10. In the embodiment of the present invention, the power supply part 50 may also be a battery. Certainly, the voltage generating unit 30 may also be powered by an external power source, where the external power source may be, for example, a data line L (as shown in FIG. 16) which is used for connecting to a data input port of the printer P. In this case, the power supply part 50 is at least a conductor L3 (shown in FIG. 17 to FIG. 19) which is connected the voltage generating unit 30 and the data line L.

The process cartridge C03 further includes a driving force transmission part 40, as shown in FIG. 5, where the driving force transmission part 40 includes a driving force receiving gear 41 and a generator drive gear 44 that engage with each other. To improve a rotation speed of the generator drive gear 44, the driving force transmission part 40 further includes at least one acceleration gear, where the acceleration gear engages with the driving force receiving gear 41 and the generator drive gear 44 respectively. Preferably, in the embodiment of the present invention, the driving force transmission part 40 further includes an acceleration gear set formed by a first acceleration gear 42 and a second acceleration gear 43 that engage with each other, where the first acceleration gear 42 engages with the driving force receiving gear 41, and the second acceleration gear 43 engages with the generator drive gear 44. The driving force receiving gear 41 cooperate with the conductive end of the developing member 14, and are configured to receive driving force from the developing member 14, then are accelerated by the acceleration gear set, and transmit the driving force to the generator drive gear 44. A rotation axis of the generator is coaxial with the generator drive gear 44, and may rotate with rotation of the generator drive gear 44. Driven by the generator drive gear 44, the generator rotates and generates power. Still as shown in FIG. 5, the process cartridge C03 further includes a conductive sheet 140 disposed at the conductive end, where the conductive sheet 140 is fixedly mounted in the conductive end cover E. A free end of the conductive sheet 140 is connected to an input end 72 of the voltage generating unit 30. After the process cartridge C03 is mounted in the printer P, the other end of the conductive sheet 140 contacts the conductive contact 71 of the printer P. Therefore, the print start-up signal 60 is transmitted to the voltage generating unit 30 by using the conductive sheet 140.

[Structure of Cooperation Between Driving Force Receiving Gear and Developing Member]

Figure 6:
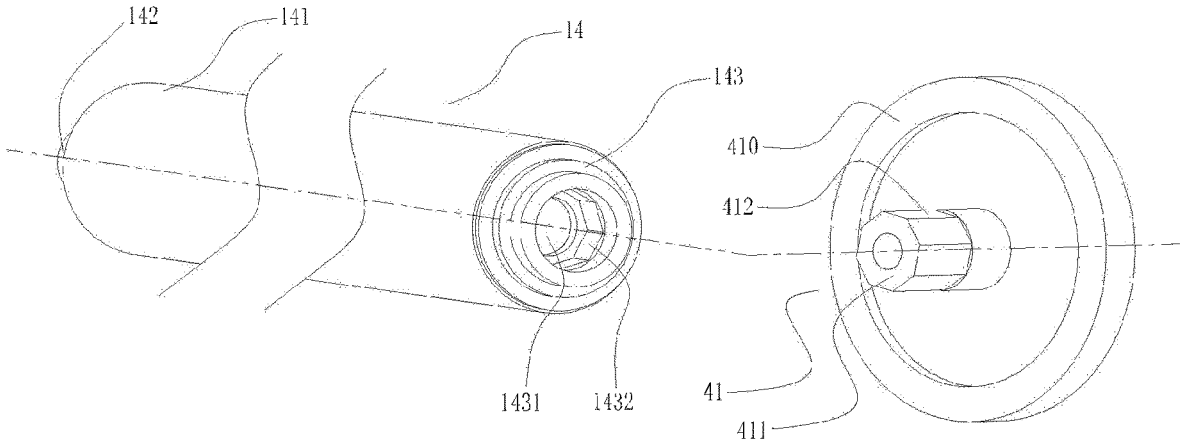
FIG. 6 is a schematic diagram of a structure of cooperation between driving force receiving gear and a developing member according to an embodiment of the present invention.

FIG. 6 is a schematic diagram of a structure of cooperation between driving force receiving gear 41 and a developing member 14 in an embodiment of the present invention. As shown in FIG. 6, the developing member 14 includes a developing sleeve 141 as well as a driving force receiving head 142 and a conductive support 143 that are respectively located at two ends of the developing sleeve, where the developing sleeve 141, driving force receiving head 142, and conductive support 143 are coaxial. The conductive support 143 takes on a cylinder shape. Along a longitudinal direction of the developing member 14, a through hole 1431 is disposed on the conductive support 143, and at least one driving force transmission plane 1432 is disposed on a sidewall of the through hole 1431. Therefore, a radial section plane of the conductive support 143 is non-circular.

Still as shown in FIG. 6, the driving force receiving gear 41 include a gear body 410 and a driving force receiving pole 411 protruding on the gear body. Preferably, the driving force receiving pole 411 takes on a pole shape and protrudes from the center of the gear body 410. Therefore, the driving force receiving pole 411 is also coaxial with the gear body 410. Correspondingly, at least one driving force receiving plane 412 for receiving driving force is disposed on the driving force receiving pole 411, where the driving force receiving plane 412 cooperates with the driving force transmission plane 1432. Certainly, the through hole 1431 having the driving force transmission plane 1432 may also be disposed on the gear body 410, and an outer surface of the conductive support 143 is disposed in a corresponding shape that can cooperate with the through hole 1431 and transmit driving force; or the through hole 1431 having the driving force transmission plane 1432 may also be disposed on the driving force receiving pole 411, and an outer surface of the conductive support 143 is disposed in a corresponding shape that can cooperate with the through hole 1431 and transmit driving force, or a protrusion that can cooperate with the through hole 1431 and transmit driving force extends from an end of the conductive support 143.

When the driving force receiving gear 41 cooperate with the developing member 14, the through hole 1431 holds the driving force receiving pole 411. Meanwhile, the driving force transmission plane 1432 cooperates with the driving force receiving plane 412. The driving force received by the driving force receiving head 142 of the developing member 14 is transmitted to the driving force receiving gear 41 by cooperation between the driving force transmission plane 1432 and the driving force receiving plane 412.

[Voltage Generating Unit]

Embodiment 1

FIG. 7 is a schematic block diagram of a voltage generating unit 30 in an embodiment of the present invention. As shown in FIG. 7, the voltage generating unit 30 includes a DC-DC boost circuit 31, a power supply electronic switch circuit 32, an oscillation circuit 34, a comparator amplifier circuit 35, a power drive circuit 36, and a transformer boost circuit 37. An input end of the DC-DC boost circuit 31 is connected to an output end of a power supply part 50; an output end of the DC-DC boost circuit 31 is connected to input ends of the power supply electronic switch circuit 32, comparator amplifier circuit 35, and power drive circuit 36 respectively; an output end of the power supply electronic switch circuit 32 is connected to an input end of the oscillation circuit 34; an output end of the oscillation circuit 34 is connected to the input end of the comparator amplifier circuit 35; the input end of the comparator amplifier circuit 35 is further connected to a conductive contact 71 in a printer P, for receiving a start-up signal 60, and an output end of the comparator amplifier circuit 35 is connected to the input end of the power supply electronic switch circuit 32 and the input end of the power drive circuit 36; an output end of the power drive circuit 36 is connected to the input end of the transformer boost circuit 37; and an output end of the transformer boost circuit 37 is connected to a conductive end of a developing member 14.

As described above, the power supply part 50 is a generator. In this embodiment, the conductive contact 71 of the printer P is a developing voltage contact, and a developing voltage supplied by the printer P to the developing member 14 is used as the start-up signal 60 of the voltage generating unit 30, that is, when the printer P starts to supply the developing voltage to a process cartridge, the voltage generating unit 30 is started simultaneously and starts to work. Furthermore, because the current of the developing voltage is very weak, the developing voltage used as the start-up signal is only used to start the voltage generating unit 30, but the current required for work of the voltage generating unit 30 is supplied by the power supply part 50. The comparator amplifier circuit 35 includes a first comparator amplifier circuit 351 and a second comparator amplifier circuit 352, where the start-up signal 60 is input to the first comparator amplifier circuit 351, that is, an input end of the first comparator amplifier circuit 351 is connected to the conductive contact 71 of the printer P, and an output end of the first comparator amplifier circuit 351 is connected to the input end of the power supply electronic switch circuit 32. An input end of the second comparator amplifier circuit 352 is connected to the output end of the oscillation circuit 34, and an output end of the second comparator amplifier circuit 352 is connected to the input end of the power drive circuit 36.

When the printer P starts to work, the generator supplies power to the whole circuit, and boosts, by using the DC-DC boost circuit 31, a voltage output by the generator to a required DC voltage, and then the power supply electronic switch circuit 32, comparator amplifier circuit 35, and power drive circuit 36 are respectively powered by the boosted DC voltage. After the start-up signal 60 is input to the first comparator amplifier circuit 351, the first comparator amplifier circuit 351 outputs a high level to drive turn-on of the power supply electronic switch circuit 32, and the power supply electronic switch circuit 32 outputs a voltage that may be supplied for the oscillation circuit 34 to work, where the oscillation circuit 34 is a self-excited oscillation circuit. Therefore, the oscillation circuit 34 may output a required frequency pulse. After the frequency pulse is compared and amplified by the second comparator amplifier circuit 352, the output pulse drives the power drive circuit 36 to work, so that the transformer boost circuit 37 works. Finally, the transformer boost circuit 37 outputs a required developing voltage and supplies it to the developing member 14.

Embodiment 2

Figure 8:
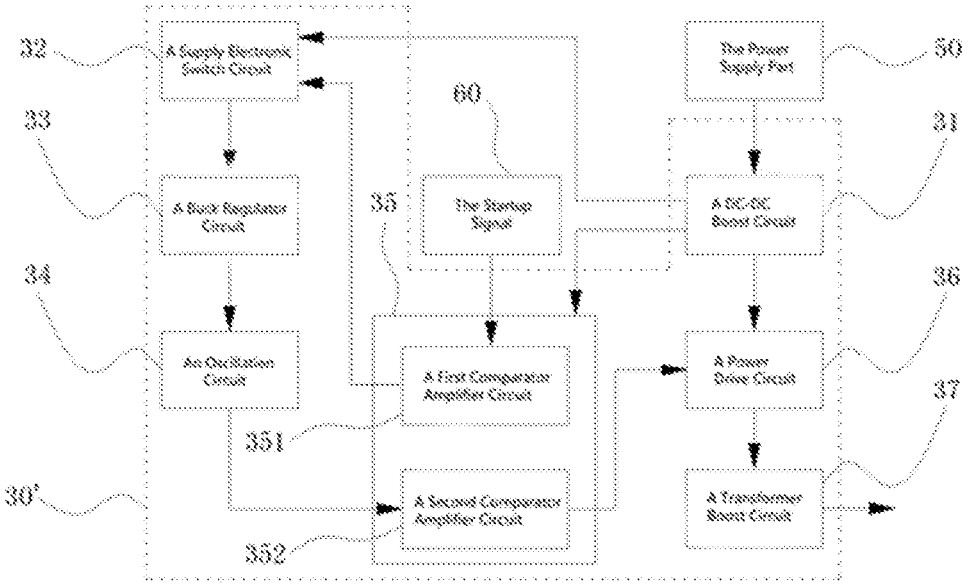
FIG. 8 is a schematic block diagram of a voltage generating unit according to another embodiment of the present invention.

FIG. 8 is a schematic block diagram of a voltage generating unit in another embodiment of the present invention. Same numbers are used for same components in this embodiment and the foregoing embodiment. As shown in FIG. 8, the voltage generating unit 30' in this embodiment further includes a buck regulator circuit 33, where an input end of the buck regulator circuit 33 is connected to an output end of a power supply electronic switch circuit 32, and an output end of the buck regulator circuit 33 is connected to an input end of an oscillation circuit 34. Access of the buck regulator circuit 33 helps to buck an output voltage of the power supply electronic switch circuit 32, so that the voltage input to the oscillation circuit 34 is more stable and is more suitable for the working voltage of the oscillation circuit 34.

In the foregoing embodiment, the start-up signal 60 is from a developing voltage contact of the developing member 14. Those skilled in the art can easily have an idea that the start-up signal 60 may further be from a charging voltage contact of the charging member 22 or a transmission voltage contact of the developer transmission member 13. Because the working time of the charging voltage contact and transmission voltage contact may be asynchronous with the working time of the developing voltage contact, if the charging voltage contact or transmission voltage contact is used as the start-up signal 60 in the present invention, a preferred solution is to add a synchronization circuit to the voltage generating unit 30'.

[Circuit of Voltage Generating Unit]

Schematic diagrams of circuits of various parts in a voltage generating unit 30 (30') are hereinafter described in detail with reference to FIG. 9 to FIG. 15.

Figure 9:
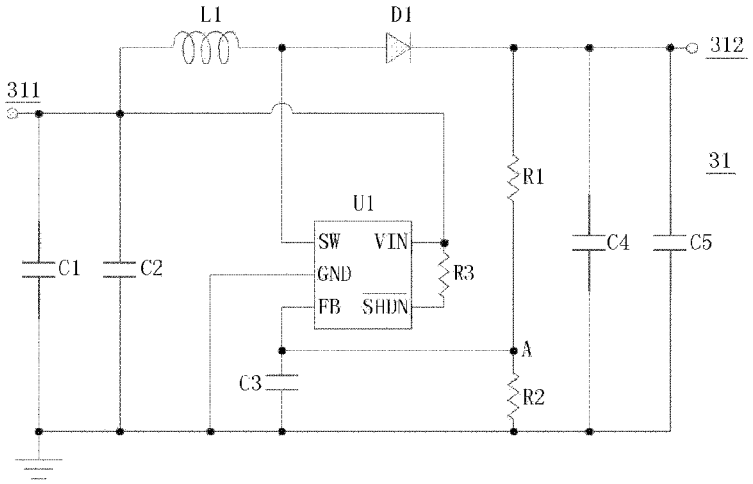
FIG. 9 is a schematic diagram of a DC-DC boost circuit.

FIG. 9 is a schematic diagram of a DC-DC boost circuit 31. The DC-DC boost circuit 31 includes a first capacitor C1, a second capacitor C2, a fourth capacitor C4, a fifth capacitor C5, a first resistor R1, a second resistor R2, a third resistor R3, a first inductor L1, a first diode D1, and a boost chip U1.

As shown in FIG. 9, the first capacitor C1 and the second capacitor C2 are connected in parallel, input ends of the two capacitors are connected to an input end 311 of the DC-DC boost circuit, and output ends of the two capacitors are grounded; an input end of the first inductor L1 is connected to the input end of the first capacitor C1, an output end of the first inductor L1 is connected to a positive electrode of the first diode D1, and a negative electrode of the first diode D1 is connected to an output end 312 of the DC-DC boost circuit; an input pin VIN of the boost chip U1 is connected to the input end of the first capacitor C1, and the input end of the first capacitor C1 is further connected to a start-up pin SHDN of the boost chip U1 by using the third resistor R3, to ensure that a voltage input to the boost chip U1 is a high voltage; a switch output pin SW of the boost chip U1 is connected to the output end of the first inductor L1, and a grounding pin GND of the boost chip U1 is grounded; an input end of the first resistor R1 is connected to the negative electrode of the first diode D1, and an output end of the first resistor R1 is connected to an input end of the second resistor R2 and a sample input pin FB of the boost chip U1; the fourth capacitor C4 and the fifth capacitor C5 are connected in parallel, input ends of the two capacitors are connected to an output end of the first diode D1, and output ends of the two capacitors are grounded.

When the voltage generating unit starts to work, the input end 311 of the DC-DC boost circuit receives a voltage output by a power supply part 50. When the voltage received by the input end 311 is at a low level, the start-up pin SHDN of the boost chip U1 is not started, and the boost chip U1 does not work. When the voltage received by the input end 311 is at a high level, the start-up pin SHDN of the boost chip U1 is started, so that the boost chip U1 starts to work. As described above, the sample input pin FB of the boost chip U1 is connected to the output end of the first resistor R1, and also further connected to the input end (namely, point A) of the second resistor R2. Therefore, the boost chip U1 may adjust an output voltage of the output end 312 of the DC-DC boost circuit 31 by determining a magnitude of an electric potential of the point A.

In the embodiment of the present invention, to filter clutter at the point A, the DC-DC boost circuit further includes a third capacitor C3. As shown in FIG. 9, an input end of the third capacitor C3 is connected to the point A, and an output end of the third capacitor C3 is grounded.

Figure 10:
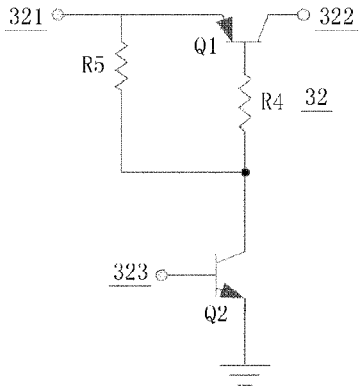
FIG. 10 is a schematic diagram of a power supply electronic switch circuit.

FIG. 10 is a schematic diagram of a power supply electronic switch circuit 32. The power supply electronic switch circuit 32 includes a fourth resistor R4, a fifth resistor R5, a first triode Q1, and a second triode Q2.

As shown in FIG. 10, the first triode Q1 is a PNP-type triode, and the second triode Q2 is an NPN-type triode; an emitter of the first triode Q1 is connected to an input end 321 of the power supply electronic switch circuit 32, a collector of the first triode Q1 is used as an output end 322 of the power supply electronic switch circuit 32, and a base of the first triode Q1 is connected to the second triode Q2 by using the fourth resistor R4, that is, one end of the fourth resistor R4 is connected to the base of the first triode Q1, while the other end of the fourth resistor R4 is connected to a collector of the second triode Q2; one end of the fifth resistor R5 is connected to the emitter of the first triode Q1, and the other end of the fifth resistor R5 is connected to the other end of the fourth resistor R4; a base of the second triode Q2, namely, a signal receiving end 323 of the power supply electronic switch circuit 32, receives a drive level output by a comparator amplifier circuit 35, and an emitter of the second triode Q2 is grounded.

In the embodiment of the present invention, the input end 321 of the power supply electronic switch circuit 32 receives a voltage output by the DC-DC boost circuit 31. When the drive level output by the comparator amplifier circuit 35 is a high level, the second triode Q2 is turned on, and the power supply electronic switch circuit 32 is turned on to work; correspondingly, when the drive level output by the comparator amplifier circuit 35 is a low level, the second triode Q2 is not turned on, and the power supply electronic switch circuit 32 is not turned on.

Figure 11:
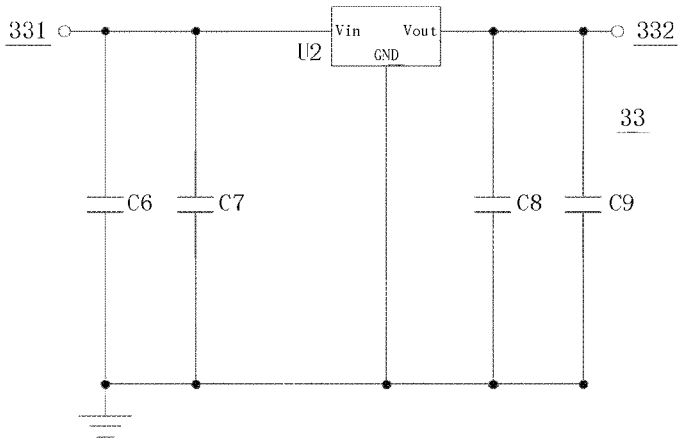
FIG. 11 is a schematic diagram of a buck regulator circuit.

FIG. 11 is a schematic diagram of a buck regulator circuit 33. The buck regulator circuit 33 includes a sixth capacitor C6, a seventh capacitor C7, an eighth capacitor C8, a ninth capacitor C9, and a buck regulator chip U2.

As shown in FIG. 11, the sixth capacitor C6 and the seventh capacitor C7 are connected in parallel, input ends of the two capacitors are connected to an input end 331 of the buck regulator circuit 33, and output ends of the two capacitors are grounded; the eighth capacitor C8 and the ninth capacitor C9 are connected in parallel, input ends of the two capacitors are connected to an output end 332 of the buck regulator circuit 33, and output ends of the two capacitors are grounded; an input pin Vin and an output pin Vout of the buck regulator chip U2 are respectively connected to the input end 331 and output end 332 of the buck regulator circuit 33, and a grounding pin GND of the buck regulator chip U2 is grounded.

In the embodiment of the present invention, after the input end of the buck regulator circuit 33 receives a voltage output by the power supply electronic switch circuit 32, the voltage is bucked, and a lower voltage is output to an oscillation circuit 34.

Figure 12:
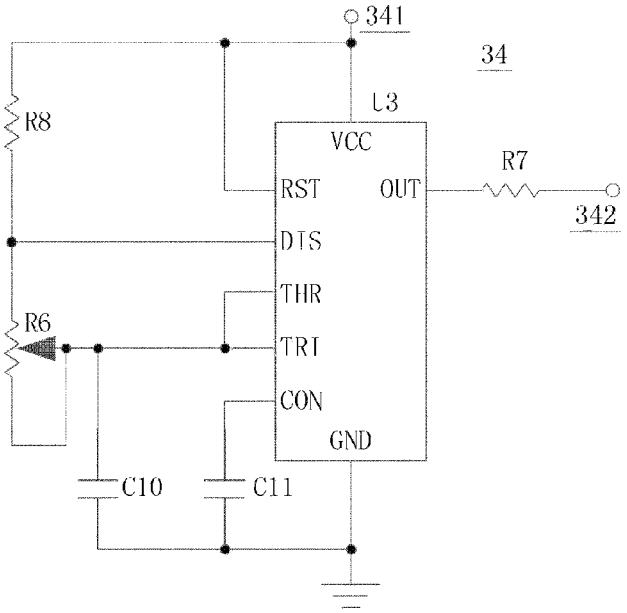
FIG. 12 is a schematic diagram of an oscillation circuit.

FIG. 12 is a schematic diagram of an oscillation circuit 34. The oscillation circuit 34 includes a tenth capacitor C10, an eleventh capacitor C11, a sixth resistor R6, a seventh resistor R7, an eighth resistor R8, and an oscillation chip U3.

As shown in FIG. 12, an input end 341 of the oscillation circuit 34 is connected to the output end 322 of the power supply electronic switch circuit 32, or connected to the output end 332 of the buck regulator circuit 33. In the embodiment of the present invention, the sixth resistor R6 is a variable resistor; one end of the eighth resistor R8 is connected to the input end 341 of the oscillation circuit 34, and the other end of the eighth resistor R8 is connected to one end of the sixth resistor R6; the other end of the sixth resistor R6 is short-circuited with a variable end of the sixth resistor R6; a power input pin VCC and a reset pin RET of the oscillation chip U3 are both connected to the input end 341 of the oscillation circuit 34, an output pin OUT of the oscillation chip U3 is connected to an output end 342 of the oscillation circuit 34 by using the seventh resistor R7, a grounding pin GND of the oscillation chip U3 is grounded, a control pin CON of the oscillation chip U3 is grounded by using the eleventh capacitor C11, a first sample pin DIS of the oscillation chip U3 is connected to the other end of the eighth resistor R8, a second sample pin THR and a third sample pin TRI of the oscillation chip U3 are short-circuited, and the third sample pin TRI of the oscillation chip U3 is further connected to the variable end of the sixth resistor R6; the variable end of the sixth resistor R6 is grounded by using the tenth capacitor C10.

That the output pin OUT of the oscillation chip U3 is connected to the output end 342 of the oscillation circuit 34 by using the seventh resistor R7 means that one end of the seventh resistor R7 is connected to the output pin OUT, while the other end of the seventh resistor R7 is connected to the output end 342 of the oscillation circuit 34. The output end 342 outputs an oscillation signal to the comparator amplifier circuit 35. That the control pin CON of the oscillation chip U3 is grounded by using the eleventh capacitor C11 means that one end of the eleventh capacitor C11 is connected to the control pin CON, while the other end of the eleventh capacitor C11 is grounded. That the variable end of the sixth resistor R6 is grounded by using the tenth capacitor C10 means that one end of the tenth capacitor C10 is connected to the variable end of the sixth resistor R6, while the other end of the tenth capacitor C10 is grounded.

Figure 13:
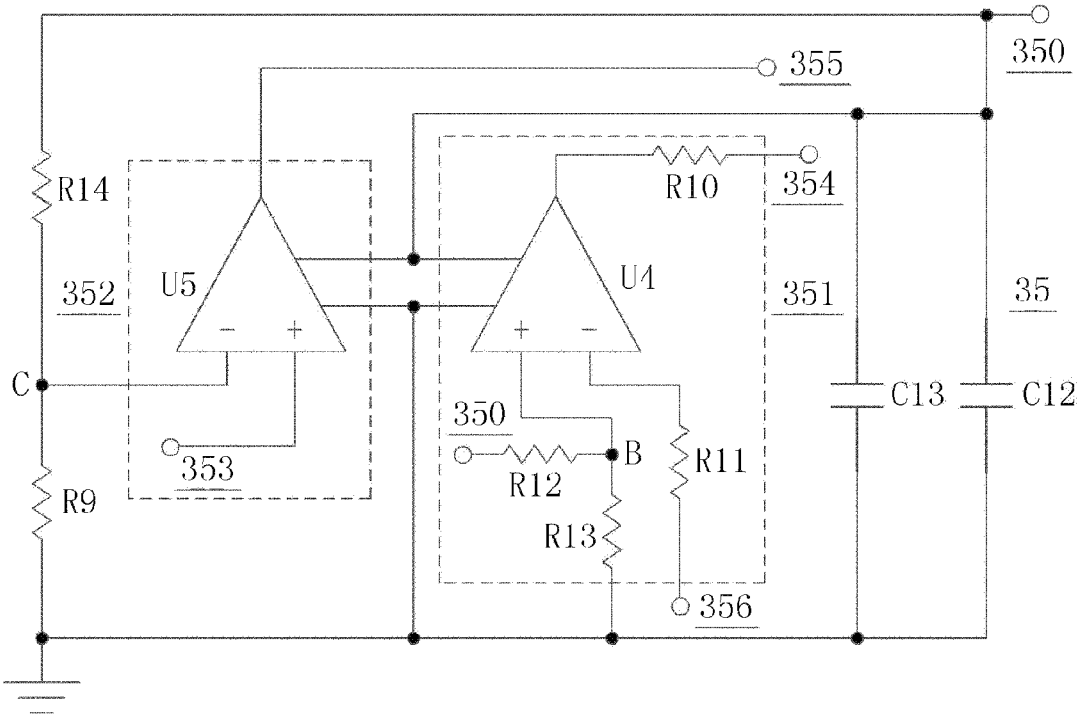
FIG. 13 is a schematic diagram of a comparator amplifier circuit.

FIG. 13 is a schematic diagram of a comparator amplifier circuit 35. The comparator amplifier circuit 35 includes a first comparator amplifier circuit 351, a second comparator amplifier circuit 352, a ninth resistor R9, a fourteenth resistor R14, a twelfth capacitor C12, and a thirteenth capacitor C13.

As shown in FIG. 13, one end of the fourteenth resistor R14 is connected to a power input end 350 of the comparator amplifier circuit 35, and the other end of the fourteenth resistor R14 is connected to one end of the ninth resistor R9 and one input end of the second comparator amplifier circuit 352; the other end of the ninth resistor R9 is grounded; the twelfth capacitor C12 and the thirteenth capacitor C13 are connected in parallel, input ends of the two capacitors are both connected to the power input end 350 of the comparator amplifier circuit 35, and output ends of the two capacitors are grounded.

The first comparator amplifier circuit 351 includes a negative comparator U4, a tenth resistor R10, an eleventh resistor R11, a twelfth resistor R12, and a thirteenth resistor R13. A positive input end of the negative comparator U4 is connected to one end of the thirteenth resistor R13 and one end of the twelfth resistor R12 respectively; the other end of the thirteenth resistor R13 is grounded, and the other end of the twelfth resistor R12 is connected to the power input end 350 of the comparator amplifier circuit 35; a negative input end of the negative comparator U4 is connected to a start-up signal input end 356 by using the eleventh resistor R11, that is, one end of the eleventh resistor R11 is connected to the negative input end of the negative comparator U4, while the other end of the eleventh resistor R11 is connected to the start-up signal input end 356; an output end of the negative comparator U4 is connected to a drive level output end 354 of the first comparator amplifier circuit 351 by using the tenth resistor R10, that is, one end of the tenth resistor R10 is connected to the output end of the negative comparator U4, while the other end of the tenth resistor R10 is connected to the drive level output end 354 of the first comparator amplifier circuit 351; a power input end of the first comparator amplifier circuit 351 is connected to the power input end 350 of the comparator amplifier circuit 35, and a grounding end of the first comparator amplifier circuit 351 is grounded.

The second comparator amplifier circuit 352 includes the positive comparator U5. As shown in FIG. 13, a positive input end of the positive comparator U5 is connected to an input end 353 of the comparator amplifier circuit 35, a negative input end of the positive comparator U5 is connected to the other end of the fourteenth resistor R14, and an output end of the positive comparator U5 is connected to an output end 355 of the comparator amplifier circuit 35; a power input end of the second comparator amplifier circuit 352 is connected to the power input end 350 of the comparator amplifier circuit 35, and a grounding end of the second comparator amplifier circuit 352 is grounded.

In the embodiment of the present invention, the input end 353 of the comparator amplifier circuit 35 is connected to the output end 342 of the oscillation circuit 34, and configured to receive a signal output by the oscillation circuit 34; the start-up signal input end 356 of the comparator amplifier circuit 35 is connected to the start-up signal 60; the drive level output end 354 of the comparator amplifier circuit 35 is connected to the base of the second triode Q2 of the power supply electronic switch circuit 32; the output end 355 of the comparator amplifier circuit 35 outputs a pulse signal after comparison.

After the start-up signal input end 356 receives a signal output by a printer P, the signal is input to the negative input end of the negative comparator U4. The negative comparator U4 compares a voltage of the input start-up signal with a voltage of a point B. If the voltage of the start-up signal is higher than the voltage of the point B, the negative comparator U4 outputs a low level. If the voltage of the start-up signal is lower than the voltage of the point B, the output end of the negative comparator, namely, the drive level output end 354 of the comparator amplifier circuit 35, outputs a high level. As described above, because the signal input end 323 of the power supply electronic switch circuit 32 is connected to the drive level output end 354 of the comparator amplifier circuit 35, the high level output by the drive level output end 354 of the comparator amplifier circuit 35 drives turn-on of the power supply electronic switch circuit 32, so that the buck regulator circuit 33 works and outputs a stable low voltage, which further causes the oscillation circuit 34 to work and output an ideal frequency pulse.

As described above, the positive input end of the positive comparator U5 is connected to the output end 342 of the oscillation circuit 34 by using the input end 353 of the comparator amplifier circuit 35. Therefore, the frequency pulse output by the oscillation circuit 34 can enter the positive comparator U5, and the positive comparator U5 compares a voltage of the pulse with a voltage of a point C. If the voltage of the pulse is lower than the voltage of the point C, the positive comparator U5 outputs a low level. If the voltage of the pulse is higher than the voltage of the point B, the positive comparator U5 outputs a high level, that is, the output end 355 of the comparator amplifier circuit 35 outputs a high level in this case.

Figure 14:
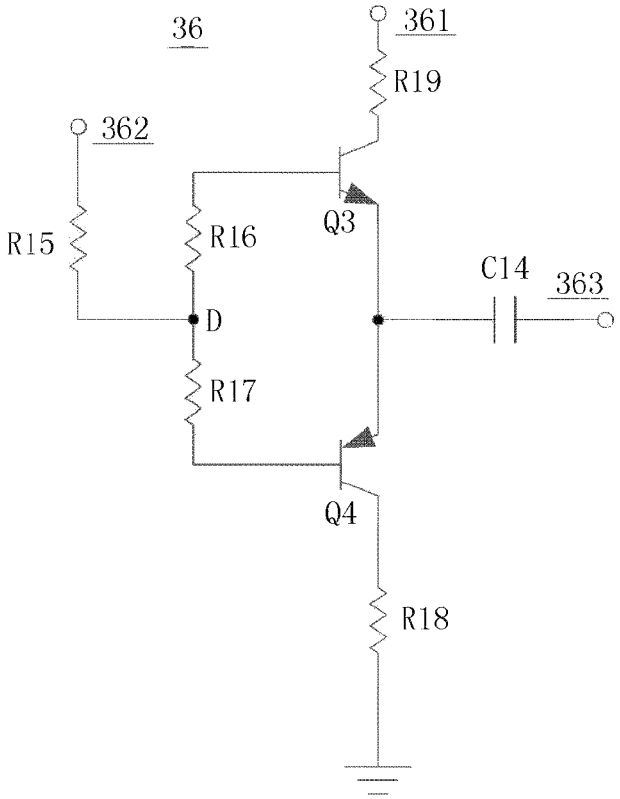
FIG. 14 is a schematic diagram of a power drive circuit.

FIG. 14 is a schematic diagram of a power drive circuit 36. The power drive circuit 36 includes a third triode Q3, a fourth triode Q4, a fifteenth resistor R15, a sixteenth resistor R16, a seventeenth resistor R17, an eighteenth resistor R18, a nineteenth resistor R19, and a fourteenth capacitor C14. As shown in FIG. 14, the third triode Q3 is an NPN-type triode, and the fourth triode Q4 is a PNP-type triode; a collector of the third triode Q3 is connected to a power input end 361 of the power drive circuit 36 by using the nineteenth resistor R19, an emitter of the third triode Q3 is connected to an emitter of the fourth triode Q4, and a base of the third triode Q3 is connected to one end of the sixteenth resistor R16; the other end of the sixteenth resistor R16 is connected to one end of the seventeenth resistor R17, and the other end of the seventeenth resistor R17 is connected to a base of the fourth triode Q4; one end of the fifteenth resistor R15 is connected to a signal input end 362 of the power drive circuit 36, and the other end of the fifteenth resistor R15 is connected to the other end of the sixteenth resistor R16; a collector of the fourth triode Q4 is grounded by using the eighteenth resistor R18; one end of the fourteenth capacitor C14 is connected to the emitter of the third triode Q3, and the other end of the fourteenth capacitor C14 is connected to an output end 363 of the power drive circuit 36.

That the collector of the third triode Q3 is connected to the power input end 361 of the power drive circuit 36 by using the nineteenth resistor R19 means that one end of the nineteenth resistor R19 is connected to the power input end 361 of the power drive circuit 36, while the other end of the nineteenth resistor R19 is connected to the collector of the third triode Q3. That the collector of the fourth triode Q4 is grounded by using the eighteenth resistor R18 means that one end of the eighteenth resistor R18 is connected to the collector of the fourth triode Q4, while the other end of the eighteenth resistor R18 is grounded.

In the embodiment of the present invention, the signal input end 362 of the power drive circuit 36 is connected to the output end 355 of the comparator amplifier circuit 35, and configured to receive a pulse signal output by the comparator amplifier circuit 35; and the output end 363 of the power drive circuit 36 outputs a power drive signal to a transformer boost circuit 37.

As described above, the signal input end 362 of the power drive circuit 36 receives a signal from the output end 355 of the comparator amplifier circuit 35. When the output end 355 of the comparator amplifier circuit 35 outputs a high level, as shown in FIG. 14, a high level exists at a point D in FIG. 14; therefore, the third triode Q3 is turned on, the fourteenth capacitor C14 starts to be charged, and the output end 363 of the power drive circuit 36 outputs a level to an input end 371 of the transformer boost circuit 37. When the output end 355 of the comparator amplifier circuit 35 outputs a low level, a low level exists at the point D in FIG. 14; therefore, the third triode Q3 is cut off, the fourth triode Q4 is turned on, and the fourteenth capacitor C14 starts to discharge by using the fourth triode Q4.

Figure 15:
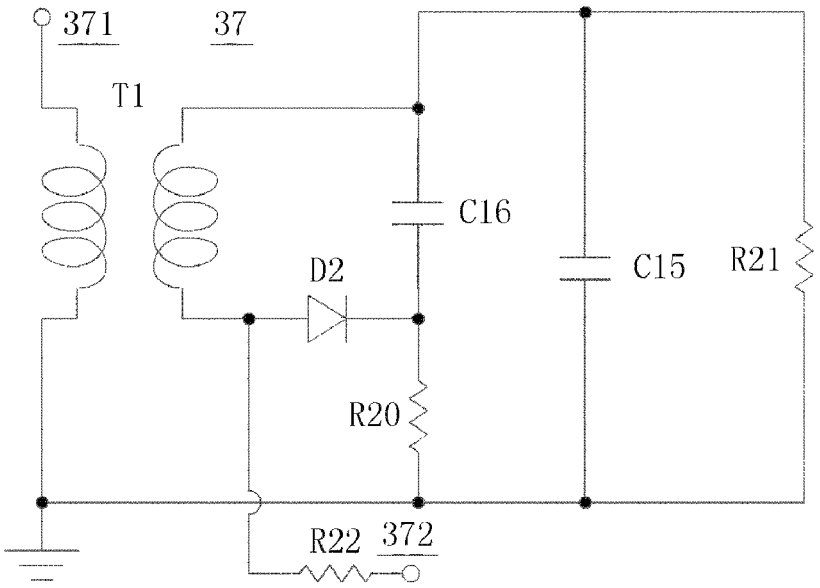
FIG. 15 is a schematic diagram of a transformer boost circuit.

FIG. 15 is a schematic diagram of a transformer boost circuit 37. The transformer boost circuit 37 includes a transformer T1, a second diode D2, a fifteenth capacitor C15, a sixteenth capacitor C16, a twentieth resistor R20, a twenty-first resistor R21, and a twenty-second resistor R22.

As shown in FIG. 15, one end of a primary coil of the transformer T1 is connected to an input end 371 of the transformer boost circuit 37, the other end of the primary coil of the transformer T1 is grounded, one end of a secondary coil of the transformer T1 is connected to one end of the sixteenth capacitor C16, and the other end of the secondary coil of the transformer T1 is connected to a positive electrode of the second diode D2; a negative electrode of the second diode is connected to the other end of the sixteenth capacitor C16; the other end of the sixteenth capacitor C16 is further grounded by using the twentieth resistor R20, that is, one end of the twentieth resistor R20 is connected to the other end of the sixteenth capacitor C16, while the other end of the twentieth resistor R20 is grounded; the fifteenth capacitor C15 and the twenty-first resistor R21 are connected in parallel, that is, one end of the fifteenth capacitor C15 and one end of the twenty-first resistor R21 are jointly connected to one end of the secondary coil of the transformer T1, while the other end of the fifteenth capacitor C15 and the other end of the twenty-first resistor R21 are jointly grounded; the other end of the secondary coil of the transformer T1 further outputs a boosted voltage by using the twenty-second resistor 22, that is, one end of the twenty-second resistor 22 is connected to the other end of the secondary coil of the transformer T1, while the other end of the twenty-second resistor 22 is connected to an output end 372 of the transformer boost circuit 37.

As described above, the input end 371 of the transformer boost circuit 37 receives a power signal output by the power drive circuit 36, and after the power signal is boosted by the transformer T1, the output end 372 of the transformer boost circuit 37 outputs a required voltage.

[Power Supply Method Using External Power Source]

FIG. 16 is a schematic diagram of data reception by a printer P in the prior art. As shown in FIG. 16, a data input port P1 is disposed on one side P0 of the printer P. A data source S is generally a computer host. A data output port Si is disposed on one side S0 of the computer host. A data line L includes a line body L0 and a first connector L1 and a second connector L2 that are respectively located at two ends of the line body. The first connector L1 is connected to the data input port P1, and the second connector L2 is connected to the data output port S1. The printer P acquires data information from the data source S by using the data line L.

Figure 18:
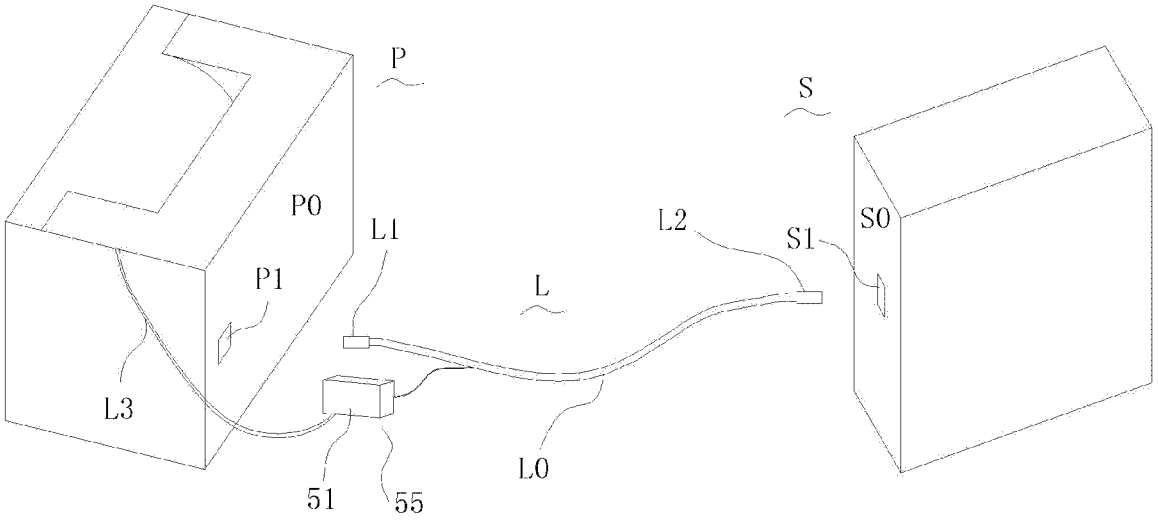
FIG. 18 is a schematic diagram of Embodiment 2 of a power supply using an external power source.
Figure 19:
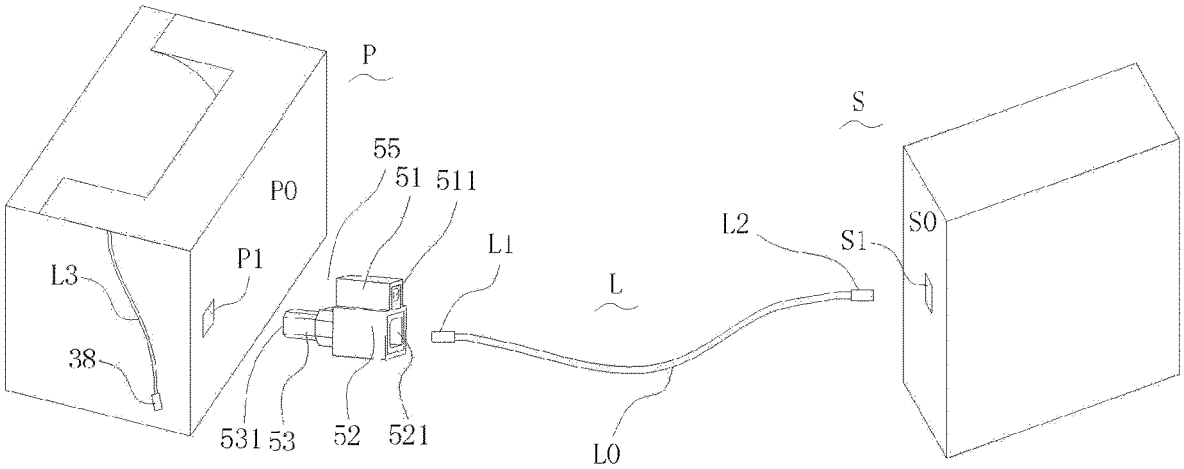
FIG. 19 is a schematic diagram of Embodiment 3 of a power supply using an external power source.
Figure 20:
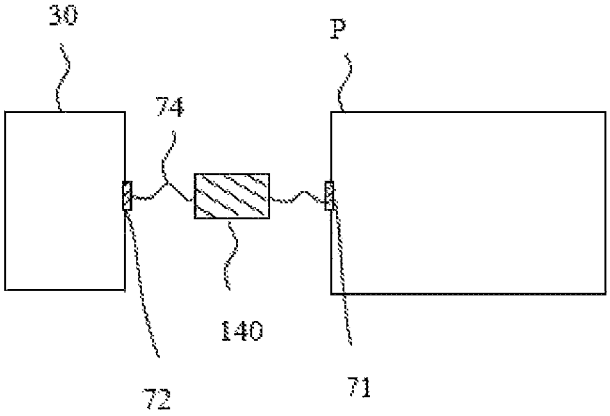
FIG. 20 is a schematic diagram showing the connection of the conductive contact and the voltage generating unit.

As described above, the voltage generating unit 30 in the process cartridge C03 of the present invention may further be powered by an external power source. The external power source, for example, may be the data line L connected to the data input port P1 of the printer. The voltage generating unit 30 is powered by using electric energy carried in transmission of data information on the data line. In this case, the power supply part 50 is at least a conductor L3 (as shown in FIG. 17 to FIG. 19) connected to the voltage generating unit 30 and the data line L.

The power supply method includes the following embodiments.

Embodiment 1

Figure 17:
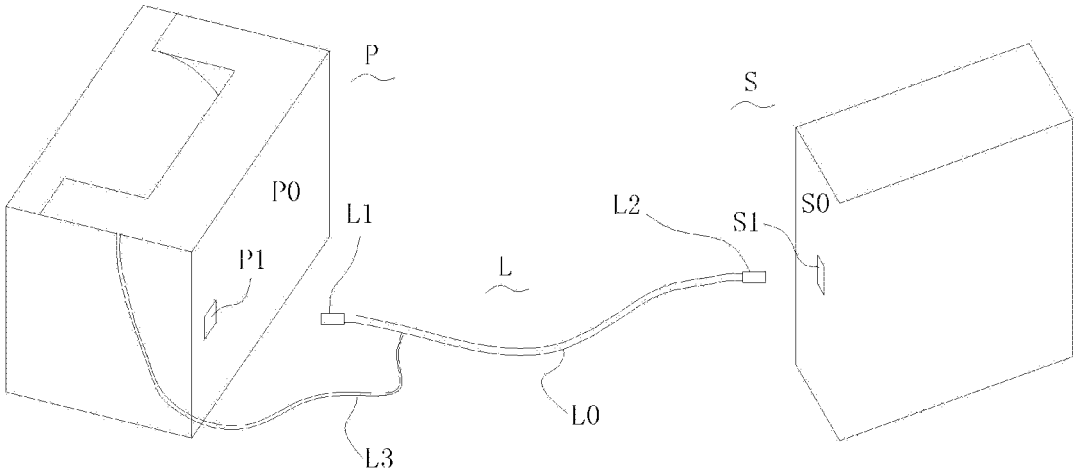
FIG. 17 is a schematic diagram of Embodiment 1 of a power supply using an external power source.

FIG. 17 is a schematic diagram of Embodiment 1 of a power supply using an external power source. This embodiment uses the following method:

Providing a conductor L3, and transmitting electric energy on the data line L to the voltage generating unit 30 (not shown in FIG. 17) by using the conductor L3.

In this embodiment, the conductor L3 is connected to the data line L and the voltage generating unit 30 respectively. Before the conductor L3 is connected to the data line L, a step of peeling off the sheath of the data line L is further included, and then one end of the conductor L3 is connected to the data line L. That the conductor L3 is connected to the voltage generating unit 30 means that the other end of the conductor L3 is connected to an input end of a DC-DC boost circuit 31 in the voltage generating unit 30. The conductor L3 and the DC-DC boost circuit 31 may be fixedly connected by welding one end of the conductor L3 to the DC-DC boost circuit 31, or may be removably connected by using a connector and a socket. When the two are connected in the first manner, the conductor L3 becomes a part of the process cartridge C03, and the two are connected during production in a factory. When the two are connected in the second manner, the conductor L3 may be a part of the process cartridge C03, or may be an independent component, which depends on the selection of the factory or a terminal user.

Embodiment 2

FIG. 18 is a schematic diagram of Embodiment 2 of a power supply using an external power source. This embodiment uses the following method:

Providing a transfer unit 55 and a conductor L3;

Connecting the transfer unit 55 to the data line L and the conductor L3 respectively; and Transmitting electric energy on the data line L to the voltage generating unit 30 (not shown in FIG. 18) by using the conductor L3 and the transfer unit 55.

As shown in FIG. 18, the transfer unit 55 is connected to the voltage generating unit 30 by using the conductor L3. In this embodiment, the transfer unit 55 includes a first transfer module 51. The first transfer module 51 may be directly connected to the data line L, or may be connected to the data line L by using a conductor (as shown in FIG. 18). In addition, the first transfer module 51 is further connected to the voltage generating unit 30 by using the conductor L3. Therefore, electric energy on the data line L may be transmitted to the voltage generating unit 30 by using the first transfer module 51 and the conductor L3.

Before the first transfer module 51 is connected to the data line L, a step of peeling off the sheath of the data line L is further included. That the first transfer module 51 is connected to the voltage generating unit 30 is specifically that the first transfer module 51 is connected to an input end of a DC-DC boost circuit 31 in the voltage generating unit 30 by using the conductor L3.

Likewise, the conductor L3 and the DC-DC boost circuit 31 in this embodiment may also be connected in the foregoing two manners. The conductor L3 and the transfer unit 55 in this embodiment may be parts of the process cartridge C03 or may be independent components.

Embodiment 3

FIG. 19 is a schematic diagram of Embodiment 3 of a power supply using an external power source. The method involved in this embodiment is the same as the method involved in Embodiment 2. A difference between the two methods lies in that a transfer unit 55 involved in this embodiment not only includes a first transfer module 51, but also includes a second transfer module 52, and a third transfer module 53, where the second transfer module 52 is electrically connected to the first transfer module 51 and the third transfer module 53 respectively. In this embodiment, preferably, the three transfer modules are not connected by using conductors but are integrated.

As shown in FIG. 19, the first transfer module 51 has a power output port 511, the second transfer module 52 has a second transfer module socket 521 that cooperates with the first connector L1, and the third transfer module 53 has a third transfer module socket 531 that cooperates with the data input port P1 of the printer. As shown in FIG. 19, one end of the conductor L3 is connected to the voltage generating unit 30, and a power interface 38 that cooperates with the power output port 511 is disposed at the other end.

Before the process cartridge C03 works, the first connector L1 is inserted to the second transfer module socket 521, the third transfer module socket 531 is inserted to the data input port P1 of the printer, and the power interface 38 is inserted to the power output port 511. As described above, the second transfer module 52 is electrically connected to the first transfer module 51 and the third transfer module 53 respectively. Therefore, the three transfer modules may be designed separately, or any two of them are integrated, or the three transfer modules are integrated as described in the foregoing preferred solution. Any manner may be used as long as it is ensured that the second transfer module 52 is electrically connected to the first transfer module 51 and the third transfer module 53 respectively. Therefore, electric energy on the data line L may be transmitted to the voltage generating unit 30 by using the transfer unit 55 and conductor L3.

In the embodiment of the present invention, the step of electrically connecting the second transfer module 52 to the first transfer module 51 and the third transfer module 53 respectively may be performed at any time before the process cartridge C03 works. In an example in which the first transfer module 51, the second transfer module 52, and the third transfer module 53 are integrated, the step of electrically connecting the second transfer module 52 to the first transfer module 51 and the third transfer module 53 respectively may be implemented before the process cartridge C03 is produced in a factory, and before the process cartridge C03 starts to work, the first connector L1 is inserted to the second transfer module socket 521, the third transfer module socket 531 is inserted to the data input port P1 of the printer, and the power interface 38 is inserted to the power output port 511; or before the process cartridge C03 starts to work, at least one step of inserting the first connector L1 into the second transfer module socket 521, inserting the third transfer module socket 531 into the data input port P1 of the printer, and inserting the power interface 38 into the power output port 511 may be implemented first, and then the second transfer module 52 is electrically connected to the first transfer module 51 and the third transfer module 53 respectively.

Likewise, in this embodiment, the conductor L3 may also be connected to a DC-DC boost circuit 31 in the foregoing two manners, and the conductor L3 and transfer unit 55 in this embodiment may be parts of the process cartridge C03 or may be independent components. Preferably, the conductor L3 is connected to the DC-DC boost circuit 31 by welding in this embodiment; however, as a part of the process cartridge C03, the transfer unit 55 is an independent component.

By using the foregoing power supply methods, stable power may be supplied to the voltage generating unit 30 in the process cartridge C03, and furthermore, it is unnecessary to attach too many components to the process cartridge C03, thereby effectively reducing the cost of the process cartridge C03.

Because a gap g exists between a developing member 14 in the process cartridge C03 and a photosensitive member 15 disposed in the process cartridge C03 or printer in the present invention, when the process cartridge C03 works, the developing member 14 and photosensitive member 15 will not be abraded due to contact between the two members, thereby prolonging the service life of the developing member 14 and photosensitive member 15. In addition, when the process cartridge C03 is mounted in a printer to which a process cartridge C01 is applicable, even if the printer to which the process cartridge C01 is applicable outputs a DC bias voltage, because the process cartridge C03 has the voltage generating unit 30, as described above, the voltage generating unit 30 supplies power by using the power supply part 50, and uses the DC bias voltage as a start-up signal to generate an AC voltage required by a developer in the process cartridge C03 for jumping over the gap g from the surface of the developing member 14 to the surface of the photosensitive member 15 to implement development. Therefore, the process cartridge C03 can also be used in the printer to which the process cartridge C01 is applicable. Likewise, the process cartridge C03 can also be used in a printer to which a process cartridge C02 is applicable. Therefore, the process cartridge C03 of the present invention can be used in a printer using contact-type developing, and can also be used in a printer using jump-type developing. Therefore, the terminal user has more choices.

What is claimed is:

1. A process cartridge detachably mounted in an electrophotographic image forming apparatus comprising a developing member, a voltage generating unit; wherein an inner wall of the electrophotographic image forming apparatus is provided with a conductive contact for outputting a DC voltage;

the developing member is rotatably mounted in the process cartridge;

the voltage generating unit is electrically connected to the conductive contact and the developing member; and the voltage generating unit receives the DC voltage from conductive contact as a start-up signal and outputs an AC bias voltage to the developing member.

2. The process cartridge according to claim 1, wherein the start-up signal is from a developing voltage contact of the developing member.

3. The process cartridge according to claim 1, wherein the process cartridge further comprises a charging member rotatably mounted in the process cartridge; and the start-up signal is from a charging voltage contact of the charging member.

4. The process cartridge according to claim 1, wherein the process cartridge further comprises a developer transmission member; and the start-up signal is from a transmission voltage contact of the developer transmission member.

5. The process cartridge according to claim 1, wherein the process cartridge further comprises a power supply part electrically connected to the voltage generating unit and supplies power for the voltage generating unit.

6. The process cartridge according to claim 1, wherein the voltage generating unit comprises a DC-DC boost circuit, a power supply electronic switch circuit, an oscillation circuit, a comparator amplifier circuit, a power drive circuit, and a transformer boost circuit; wherein, an input end of the DC-DC boost circuit is connected to an output end of the power supply part;

an output end of the DC-DC boost circuit is connected to input ends of the power supply electronic switch circuit, comparator amplifier circuit, and power drive circuit respectively;

an output end of the power supply electronic switch circuit is connected to an input end of the oscillation circuit;

an output end of the oscillation circuit is connected to the input end of the comparator amplifier circuit;

the input end of the comparator amplifier circuit is further connected to the conductive contact, and an output end of the comparator amplifier circuit is connected to the input end of the power supply electronic switch circuit and the input end of the power drive circuit;

an output end of the power drive circuit is connected to the transformer boost circuit; and an output end of the transformer boost circuit is connected to a conductive end of the developing member.

7. The process cartridge according to claim 6, wherein the comparator amplifier circuit comprises a first comparator amplifier circuit and a second comparator amplifier circuit; wherein, an input end of the first comparator amplifier circuit is connected to the conductive contact;

an output end of the first comparator amplifier circuit is connected to the input end of the power supply electronic switch circuit;

an input end of the second comparator amplifier circuit is connected to the output end of the oscillation circuit; and an output end of the second comparator amplifier circuit is connected to the input end of the power drive circuit.

8. The process cartridge according to claim 7, wherein the voltage generating unit further comprises a buck regulator circuit; wherein an input end of the buck regulator circuit is connected to the output end of the power supply electronic switch circuit; and an output end of the buck regulator circuit is connected to the input end of the oscillation circuit.

9. The process cartridge according to claim 5, wherein the electrophotographic image forming apparatus acquires data information by using a data line; and the power supply part is a battery or a generator or is at least a conductor connected to the voltage generating unit and the data line.

10. The process cartridge according to claim 9, wherein the power supply part is a generator;

the process cartridge further comprises a driving force transmission part; wherein the driving force transmission part comprises a driving force receiving gear and a generator drive gear engaged with each other;

the driving force receiving gear cooperate with the conductive end of the developing member;

the generator drive gear is coaxial with a rotation axis of the generator;

the driving force receiving gear comprises a gear body and a driving force receiving pole protruding on the gear body; and the driving force receiving pole protrudes from a center of the gear body.

11. The process cartridge according to claim 10, wherein the driving force transmission part further comprises an acceleration gear set, wherein the acceleration gear set comprises a first acceleration gear and a second acceleration gear engaged with each other;

the first acceleration gear engages with the driving force receiving gear;

the second acceleration gear engages with the generator drive gear;

the developing member comprises a developing sleeve as well as a driving force receiving head and a conductive support respectively located at two ends of the developing sleeve;

along a longitudinal direction of the developing member, a through hole is disposed on the conductive support; and at least one driving force transmission plane is disposed on a sidewall of the through hole.

12. The process cartridge according to claim 11, wherein the conductive support has a cylinder shape, and a radial section plane of the conductive support is non-circular.

13. The process cartridge according to claim 10, wherein at least one driving force receiving plane for receiving driving force is disposed on the driving force receiving pole; and the driving force receiving plane cooperates with the driving force transmission plane.

14. The process cartridge according to claim 1, wherein the process cartridge further comprises a photosensitive member rotatably mounted in the process cartridge; and a gap exists between the photosensitive member and the developing member.

15. A power supply method for a process cartridge, wherein the process cartridge is detachably mounted in an electrophotographic image forming apparatus;

an inner wall of the electrophotographic image forming apparatus is provided with a conductive contact for outputting a DC voltage;

data information is acquired from a data source by using a data line;

the process cartridge comprises a voltage generating unit and a developing member rotatably mounted in the process cartridge; and the voltage generating unit is electrically connected to the conductive contact and the developing member;

the power supply method for a process cartridge comprises:

providing a conductor;

transmitting electric energy on the data line to the voltage generating unit by using the conductor;

receiving, by the voltage generating unit, the DC voltage from conductive contact as a start-up signal; and outputting, by the voltage generating unit, an AC bias voltage to the developing member.

16. The method according to claim 15, wherein the conductor is connected to the data line and the voltage generating unit respectively.

17. A power supply method for a process cartridge, wherein the process cartridge is detachably mounted in an electrophotographic image forming apparatus;

an inner wall of the electrophotographic image forming apparatus is provided with a conductive contact for outputting a DC voltage;

data information is acquired from a data source by using a data line;

the process cartridge comprises a voltage generating unit and a developing member rotatably mounted in the process cartridge; and the voltage generating unit is electrically connected to the conductive contact and the developing member;

the power supply method for a process cartridge comprises:

providing a transfer unit and a conductor;

connecting the transfer unit to the data line and the conductor respectively;

transmitting electric energy on the data line to the voltage generating unit by using the conductor and the transfer unit;

receiving, by the voltage generating unit, the DC voltage from conductive contact as a start-up signal; and outputting, by the voltage generating unit, an AC bias voltage to the developing member.

18. The method according to claim 17, wherein the transfer unit comprises a first transfer module, wherein the first transfer module is connected to the data line, and connected to the voltage generating unit by using the conductor.

19. The method according to claim 17, wherein the transfer unit comprises a first transfer module, a second transfer module, and a third transfer module, wherein the second transfer module is electrically connected to the first transfer module and the third transfer module respectively.

20. The method according to claim 19, wherein the first transfer module has a power output port, the second transfer module has a second transfer module socket, and the third transfer module has a third transfer module socket;

one end of the conductor is connected to the voltage generating unit, and a power interface is disposed on the other end; and the power output port is connected to the power interface, the second transfer module socket is connected to one end of the data line, and the third transfer module socket is connected to the electrophotographic image forming apparatus.

* * * * *